US005992067A

United States Patent [19]

Strawbridge

[11] Patent Number: 5,992,067

[45] Date of Patent: Nov. 30, 1999

[54] ON-SITE INTERCHANGEABLE NEON SIGN

[75] Inventor: Jon P Strawbridge, Glendale, Wis.

[73] Assignee: Everbrite, Inc., Greenfield, Wis.

[21] Appl. No.: 08/945,260

[22] PCT Filed: May 2, 1995

[86] PCT No.: PCT/US95/05399

§ 371 Date: Oct. 21, 1997

§ 102(e) Date: Oct. 21, 1997

[87] PCT Pub. No.: WO96/35202

PCT Pub. Date: Nov. 7, 1996

[51] Int. Cl.[6] ..... G09F 13/26

[52] U.S. Cl. ..... 40/545

[58] Field of Search ..... 40/545, 550, 558

[56] References Cited

U.S. PATENT DOCUMENTS

| | | | |
|---|---|---|---|
| 1,824,204 | 9/1931 | Fitch | 40/545 |
| 1,951,502 | 3/1934 | Cadieux | 40/545 |
| 2,059,451 | 11/1936 | Green | 40/545 |
| 3,085,224 | 4/1963 | Becka | 40/545 |
| 4,434,569 | 3/1984 | Minogue | 40/545 |
| 4,953,314 | 9/1990 | Moulton | 40/545 |
| 5,533,286 | 7/1996 | Fallon et al. | 40/545 |

*Primary Examiner*—Brian K. Green
*Assistant Examiner*—Marcus Dolce
*Attorney, Agent, or Firm*—Ryan Kromholz & Manion

[57] ABSTRACT

A generally planar base panel member has mounted to its back face a pair of laterally spaced apart chambers whose open fronts are covered by the panel. A pair of electrical receptacles in each chamber are arranged in alignment with apertures in the base panel. First and second front panels each have a neon tubing configuration mounted on a front side of the panel with the electric end terminals at opposite ends of the tubing configurations projecting through holes in the front panels so that when the front panels are juxtaposed to the front of the base panel the neon tube terminals plug into the receptacles. A power supply for neon tubing is mounted to the back face of the base panel member. The neon tubing configurations on the individual front panels when plugged into the receptacles form a series circuit which connects across the high voltage output terminals of the power supply.

14 Claims, 5 Drawing Sheets

72
53
43
45
49
65
71
63
51
40
47
46
70
50
19
18
48
13
127
42
52
61
24
59
19
64
41
14
44
19
25
62
128
60
66
67
11
30
19
12

63
74
73
159
43
77
11
70
71
76
75
13
78
72
65
79

FIG. 6
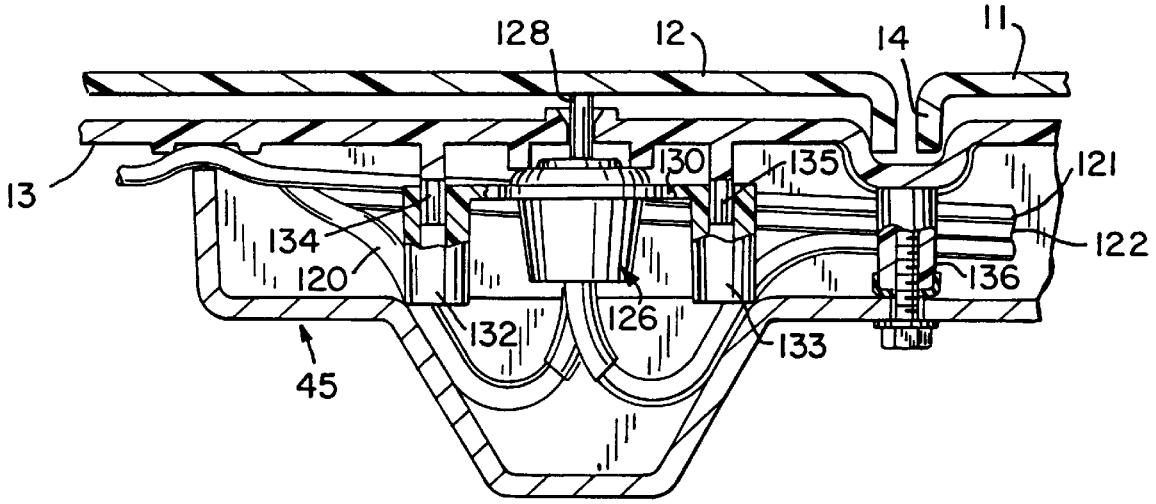
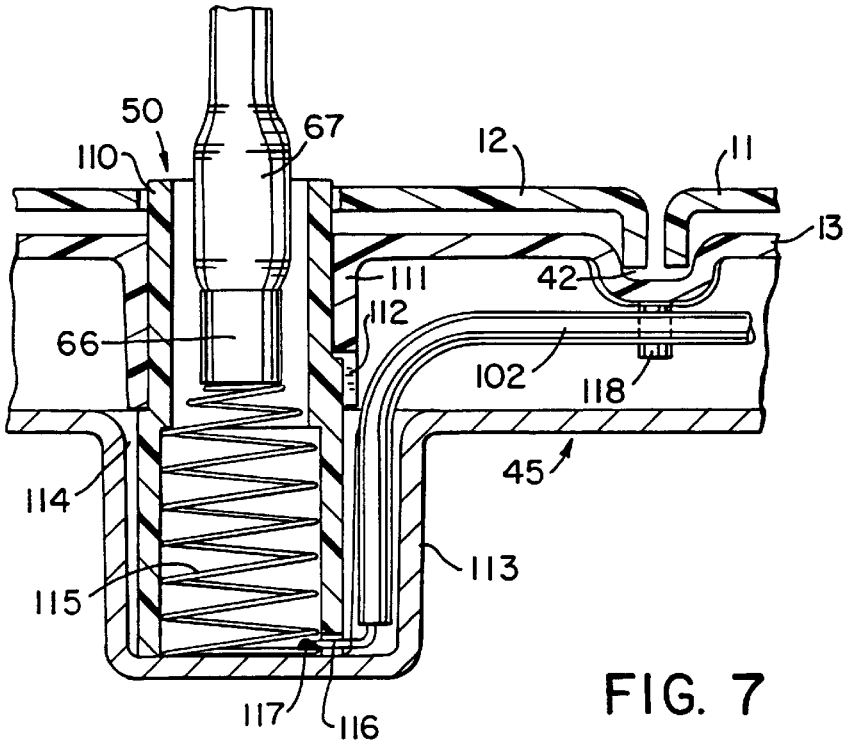
FIG. 7

ON-SITE INTERCHANGEABLE NEON SIGN

BACKGROUND OF THE INVENTION

The invention disclosed herein pertains to a neon sign that provides for easy exchangeability of the neon tubing that is configured to display verbal and/or artistic information without the need to return the sign to the manufacturer for the purposes of exchange.

Historically, neon signs are custom made and remain in their original form for their entire life. A customer will buy a sign base or frame to which is mounted one or more power sources such as step-up transformers or electronic power supplies for energizing the tubing that is mounted to the base. If the neon tubing configurations that are formed to create a verbal or artistic effect become anachronistic or obsolete or if the gas in the tube begins to fade or flicker, it is often the case that the sign must be sent back to the manufacturer or a service person must be called to repair or change it.

Relatively small neon signs designed for indoor use are often placed at the point-of-sale of goods or services to create an effect or impression that is appropriate for some contemporary purpose but is at risk of becoming obsolete before the physical life of the sign has ended. For example, there are occasions were a business would like to replace the neon tubing in a sign and, in particular, the information or artistry it conveys because the original purpose of the sign has disappeared. One example would be where the sign naming or showing the shape of a new product is expressed by neon tubing. After the product is introduced and promoted adequately, the merchant or vendor may want to substitute the name of another product or a new brand name written by neon tubing. Some signs used at the point-of-sale may use neon tubing configured to create information of current but transitory interest to an event such as "Super Bowl" or "Olympics" in connection with a brand name to create a pleasing impression and natural association of a product with the event. When the event has occurred the sign owner may desire to replace the tubing to define a more contemporaneous scene.

The word neon tubing is used herein as a generic term which includes within its scope tubing containing other substances that can be excited to luminesce such as other inert gases and vaporized metals such as mercury and sodium.

SUMMARY OF THE INVENTION

An objective of the invention is to provide a neon sign whose neon tubing configurations can be exchanged easily in the field at the point-of-sale or other site.

A corollary of the foregoing objective is to provide a sign that affords a convenient and cost effective way to re-customize it to provide regional, seasonal, geographic or other specialized information for commercial purposes.

Another objective is to provide a sign of the type briefly outlined above which can be suspended in a window, mounted in space or mounted to a wall.

According to the invention, the new sign is comprised of a generally planar base member to which a neon tube power supply may be mounted. The base member has a plurality of electrical receptacles into which the end terminals of independent neon tubing configurations plug. The receptacles are connected into the high voltage output circuitry of the power supply. Individual neon tubing configurations are supported on separate front panels composed of non-conductive materials such as a planar plastic panel. The end terminals of the individual neon tubing configurations project rearwardly on the front panels and are arranged in a standardized pattern that corresponds to the standardized pattern of the receptacles on the base member. Each neon tubing carrying front panel is adapted for being juxtaposed to the front of the base member such that when the panel with the neon tubing on it is pressed lightly, the tubing terminals plug into the receptacles. Latch keys are provided for latching the tubing carrying panels to the base member. Momentary switches are mounted to the base member and are connected in the low voltage infeed circuitry of the power supply. These switches are normally open and are only closed to energize the power supply if both neon tubing panels are latched in place so exposure to high voltage is precluded.

If the sign owner wants to order replacement or interchangeable neon tubing configurations, it is not necessary to specify the position of the tubing terminals since the manufacturer has standardized the spacing of the terminals and the spacing of the receptacles in the base member so the properly shaped tubing will be provided.

How the foregoing and other more specific objectives of the invention are achieved will be evident in the ensuing more detailed description of a preferred embodiment of the new sign which will now be set forth in reference to the drawings.

DESCRIPTION OF THE DRAWINGS

FIG. 6 is a fragmentary sectional view taken on a line corresponding to 6—6 in FIG. 3 showing parts of the transparent plastic neon tubing carrying panels (tubing omitted) with a pin extending from a panel actuating a momentary switch to a closed condition as is the case when the front neon tube carrying panels are juxtaposed and latched to the base member of the sign;

FIG. 7 is a fragmentary sectional view taken on a line corresponding to 7—7 in FIG. 3 showing a neon tube end terminal plugged into a receptacle for contacting a conductive spring and showing how conductors are arranged for connecting receptacles in a series circuit which is completed only when both neon tubing configurations are plugged into the receptacles and some safety switches are closed;

DESCRIPTION OF A PREFERRED EMBODIMENT

Figure 1:
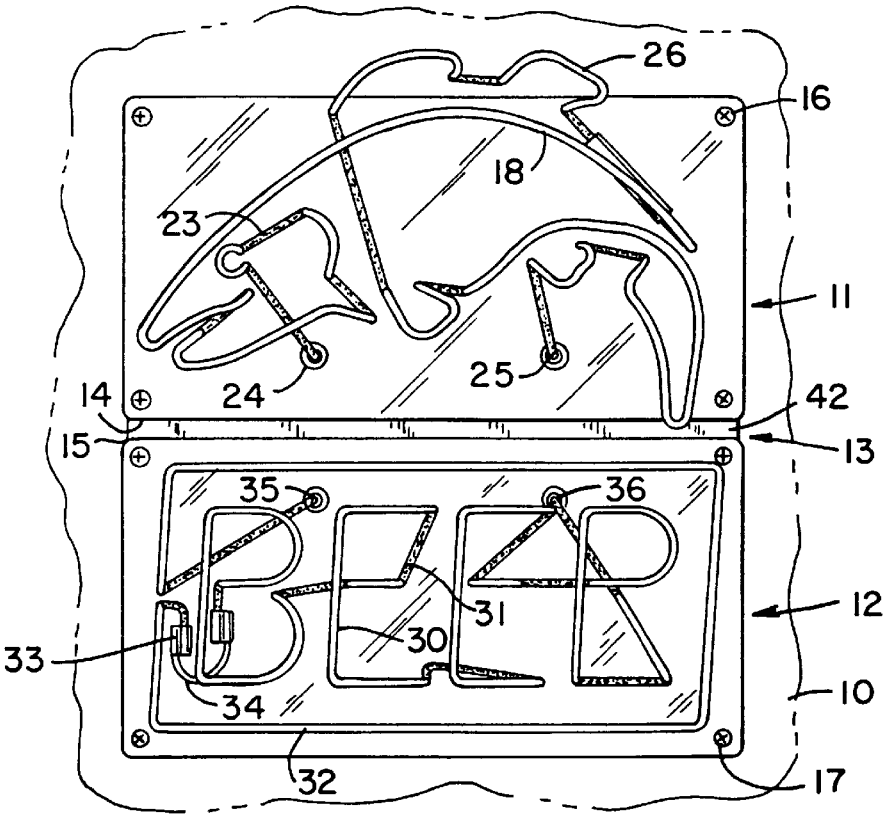
FIG. 1 is a frontal view of the new sign in a situation where the sign is mounted to a wall.

The assembled and operating sign in FIG. 1 is mounted on a wall 10. From the front of the sign one may see that it comprises synthetic resin, which is preferably transparent front panels 11 and 12. In an actual embodiment the panels 11 and 12 are composed of polycarbonate. Part of a generally planar base member 13 or rear panel is exposed between upper and lower rims 14 and 15 of the respective front panels 11 and 12. Front panels 11 and 12 are releasably latched to base member 13 by means of latch keys such as the one of four marked 16 that latch the neon tubing carrying front panel 11 to the rear base member 13 and the one marked 17 that is one of four latch keys latching the front panel 12 to base member 13. The latch keys are rotatable in one direction to secure the front panels to the base members and in the opposite direction to release the panels from the base member. A typical latch key will be described in detail later.

In FIG. 1, neon tubing 18 is formed in the shape or outline of an image such as that of a fish for the sake of illustrating an artistic capability of the sign. The neon tubing 18 is supported in spaced relationship with the front panel 11 by means of standoff tube supports such as the support 19 in FIG. 4. This is conventional practice in neon signs. Typical tube support 19 comprises a cylindrical plastic body 20 containing a coil spring, not visible, providing bidirectional resilient support for a plastic stem 21. The stem terminates in a resilient c-shaped gripping element 22 into which the neon tubing 18 is pressed.

Parts of the neon tubing, such as where the lead line of numeral 18 touches the tubing, can be clear or opalescent white or colored glass which transmits the luminescence of the gas or vapor in the tubing to outline the fish. Parts of the tubing marked 23 are opaque to suppress their visibility when the tubing is illuminated although such parts are needed for maintaining conductive continuity along the tubing from one end terminal portion 24 of the tubing to the other end terminal portion 25. Parts of the tubing that contribute to visualization of the sign may be colored glass. Other parts may be clear glass.

The neon tubing 30 mounted to the lower front panel 12 in FIG. 1 is shaped to form a verbal image represented by the word "Beer." The tubing has sections 31 which are opaque and are not readily visualized when the other clear or translucent glass parts of the tubing are luminescing. The tubing 30 is supported on a plurality of neon tube supports 19 which are not perceptible in FIG. 1. Tubing 30, configured as the word "Beer", may be defined by glass that is clear, colored, or otherwise translucent to obtain color variations. The tubing portion 32 providing a rectangular frame for the word "Beer" is connected in series with the "Beer" tubing 30. Tubing portions 30 and 32 may contain different gases or vapors to obtain different colors. For example, rectangularly formed tubing 32 may be clear glass containing neon gas in which case the tubing 32 will emit red light. Tubing 30 may, by way of illustration, be white glass filled with krypton for emitting blue light. The gases or vapors in the tubing sections do not mix or interchange because these sections are terminated at their sealed electrode ends, not visible, but which have an exposed conductive part. The conductive parts are plugged into connectors 33 which are interconnected by insulating jumper wire 34. Opposite end portions 35 and 36 of tubing sections 30 and 32 are terminated with electrodes, not shown, which are sealed into the glass tubing ends and have an exposed conductive terminal part for plugging into electric receptacles mounted in the base member as will be explained in detail later.

Figure 2:
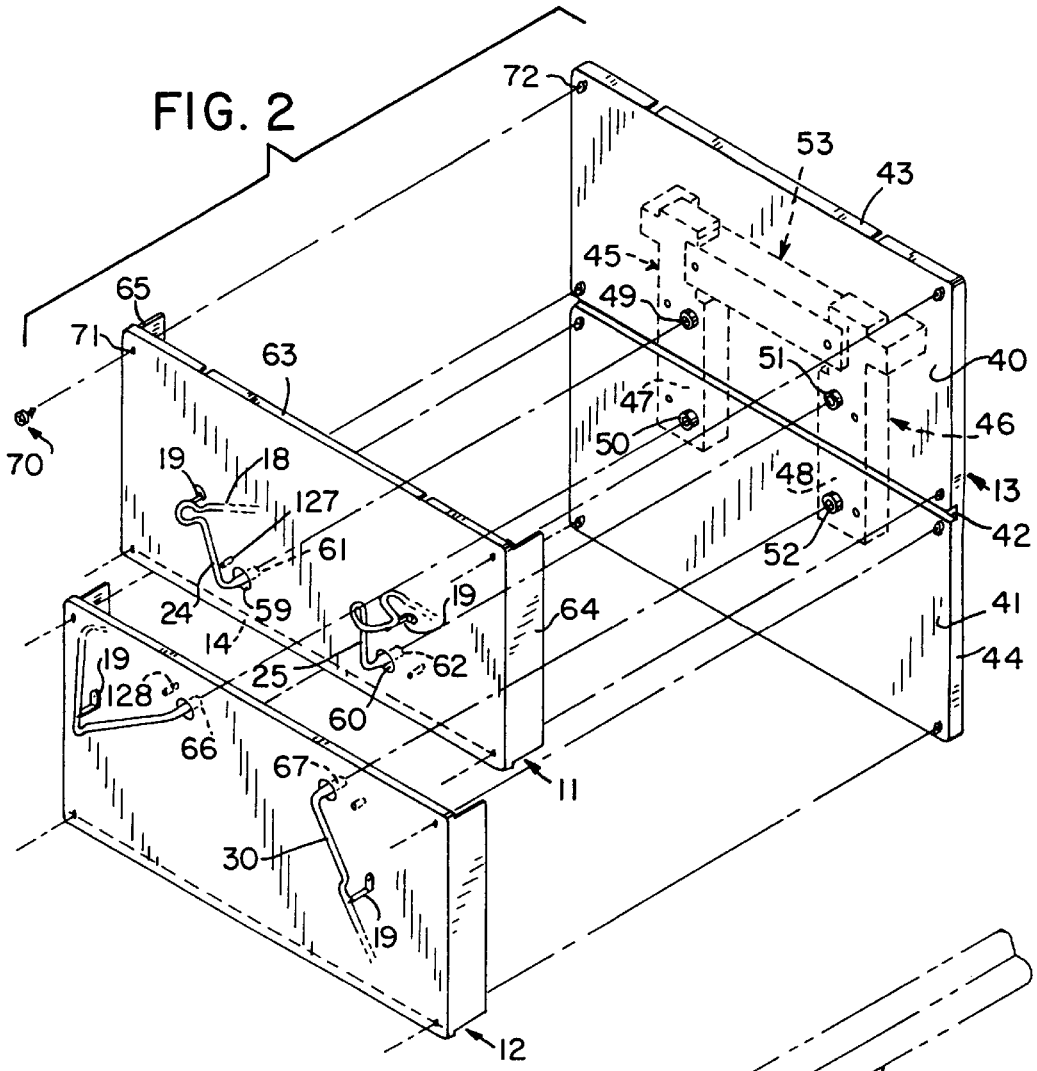
FIG. 2 is a perspective exploded view of the interchangeable sign with all but the end terminals of the two neon tubing configurations broken away for the sake of simplification.

Attention is now invited to FIG. 2. This figure shows the mostly planar base member 13 and the two mostly planar front neon tubing carrying panels 11 and 12 in greater detail. The base member is comprised of two planar molded sections 40 and 41 that are united and constituted as a single piece of synthetic resin which is polycarbonate resin in the commercial product. The generally planar base member 13 has a transverse or laterally extending channel 42 formed in it. Channel 42 has a purpose as will be explained soon. Base member 13 has integrally molded stiffener rims, two of which, 43 and 44 are visible in FIG. 2. Left and right chambers 45 and 46, respectively, mounted to the back of base member panel 13 for containing electrical components will be discussed shortly hereafter in reference to FIG. 3. In FIG. 2, chambers 45 and 46 could be characterized as troughs which are open on their front faces 47 and 48 as viewed in FIG. 2. When the chambers 45 and 46 are mounted to the base member panel 13 their front faces are closed or covered by the panel. Chambers 45 and 46 contain frontwardly projecting electrical receptacles which are generally designated by the numerals 49, 50, 51 and 52. The high voltage, high frequency electronic power supply is generally designated by the numeral 53 and is seen to comprise an oblong casing for electronic components, not shown. A pull cord 37 extends from power supply 53. A switch, not visible, in the power supply is operated to on and off states by pulling cord 37 to turn on and turn off the power supply. The illustrated power supply 53 that is used in the commercial embodiment is identified by the registered trademark "Evertron" and is made by a subsidiary of Everbrite, Inc., to which this application is assigned.

Transparent plastic front panels 11 and 12 are similar. If they are inverted one can replace the other. This means that only one type of front panel 11 or 12 needs to be molded which results in manufacturing economy and requires inventory of only one kind of panel. Typical neon tubing supporting upper panel 11 may be molded and composed of a clear synthetic resin or plastic such as polycarbonate resin. Most of the neon tubing on upper panel 11 is broken away for the sake of simplifying the drawing in FIG. 2. The end portions of tubing 18 are marked 24 and 25 as they are in FIG. 1. The face of upper front panel 11 has two holes 59 and 60. The conductive end terminals of neon tubing configuration of the fish 18 are designated generally by the numerals 61 and 62 in FIG. 2. The end terminals 61 and 62 constitute male electric plugs that plug into female electric receptacles 49 and 50 when panel 11 is assembled in juxtaposition with generally planar base member 13. Panel 11 has an integrally molded upper laterally and rearwardly extending rim 63 and a similar lower rim 14 which was mentioned when FIG. 1 was being discussed earlier. Rim 63 on panel 11 overlaps rim 43 of base member 13 when panel 11 is juxtaposed to the base member. Lower similar rim 14 of panel 11 registers in transverse channel 42 formed in base member 13. The structure resembles a tongue and groove assembly where rim 63 serves as a tongue and channel 42 serves as the groove. Cooperating rims 63, 53 and rim 14 registered in channel 42 result in the relatively lightweight panel 11 and neon tube combination being supported mainly on base member 13 against gravitational forces which might otherwise impart a shear force on a neon tubing when the male end terminal 61 and 62 are plugged into the female electric receptacles 49 and 51.

Front panel 11 has integrally molded side walls 64 and 65. Side wall 64 overlaps rim 44 of base member 13 when front panel 11 is assembled in juxtaposition to the base member. The side walls 64, 65 prevent any forces applied laterally to panel 11 from imposing any shear force on the neon tubing end portions.

Neon tubing configuration carrying front panels 11 and 12 are releasably latched to base member 13 with latch keys such as a latch key identified generally by the numeral 70 in FIG. 2 wherein a keyhole in panel 11 is marked 71 and a key retainer element in base member 13 is marked 72. The latch key 70 and cooperating parts are shown in detail in FIG. 8 to which attention is now invited.

Figure 8:
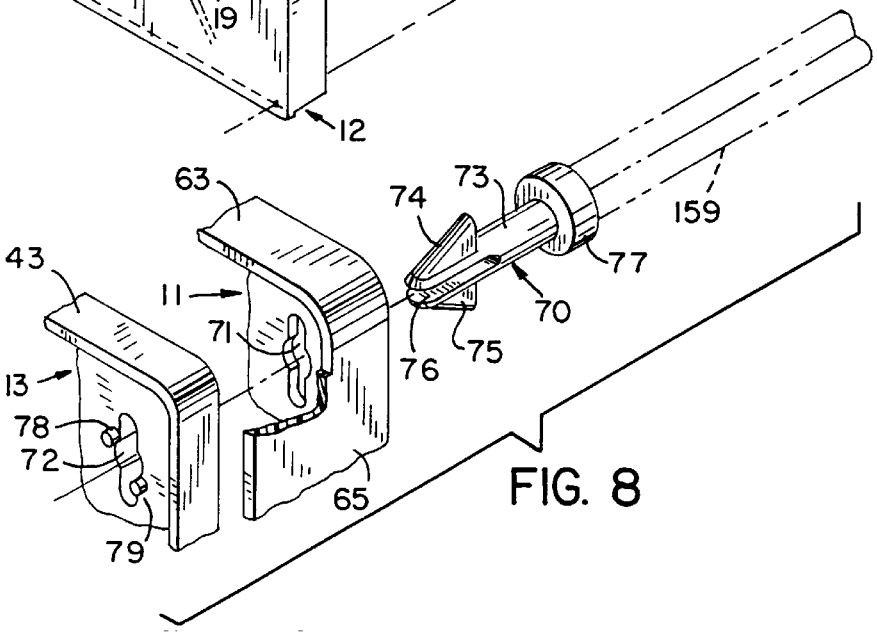
FIG. 8 is a fragmentary perspective view of a latch key poised to be inserted through a keyhole in a panel and through a keyhole in the sign base member such that turning the latchkey 90° latches a neon tubing carrying front panel to the base member.

In FIG. 8 latch key 70 is shown to comprise a cylindrical shank 73 made of plastic material as is the whole key. The shank has diametrically opposite tapered prongs 74 and 75 extending radially from it. The end of the shank has an axial slot 76 to impart flexibility. A fragment of neon tubing carrying front panel 11 is shown in FIG. 8 for demonstrating that each front panel has a key hole slot 71. Keyhole slot 71 needs to be a little wider than the prongs for the tapered prongs 74 and 75 to pass through and the slot must be a little longer than the total radial length of the prongs but it must be small enough to prevent the cylindrical head 77 on the shank to pass through. Base member 13 has in each of its corners a latching keyhole 72. Two molded stop pins 78 and 79 project alongside of latch key 72.

To fasten front panel 11 in FIG. 8 to base member 13, the panel 11 is pressed in juxtaposition to the base member. Then the slotted prongs of the latch key 70 are passed through keyhole slot 71 and keyhole 72. The latch key is then rotated one quarter turn in either direction until the tapered prongs 74 and 75 stop against pins 78 and 79. Then, because of prongs 74 and 75 being wider radially than the width of slot 72 the latch key can not withdraw unless it is turned manually by one quarter turn.

The cylindrical head 77 of each latch key 70 is slotted, not visible, similar to a Philips screw head so the latch key can be turned with a coin or a screwdriver. The key can also be turned by gripping head 77 with the fingers. It will be evident that either of the neon tubing carrying front panels 11 or 12 can be interfaced with base member 13 so the terminals on the neon tubes plug into the receptacles 49, 51 and 50, 52. Then, in seconds the latch keys can all be turned to secure the panels 11 and 12 to base member 13.

Figure 3:
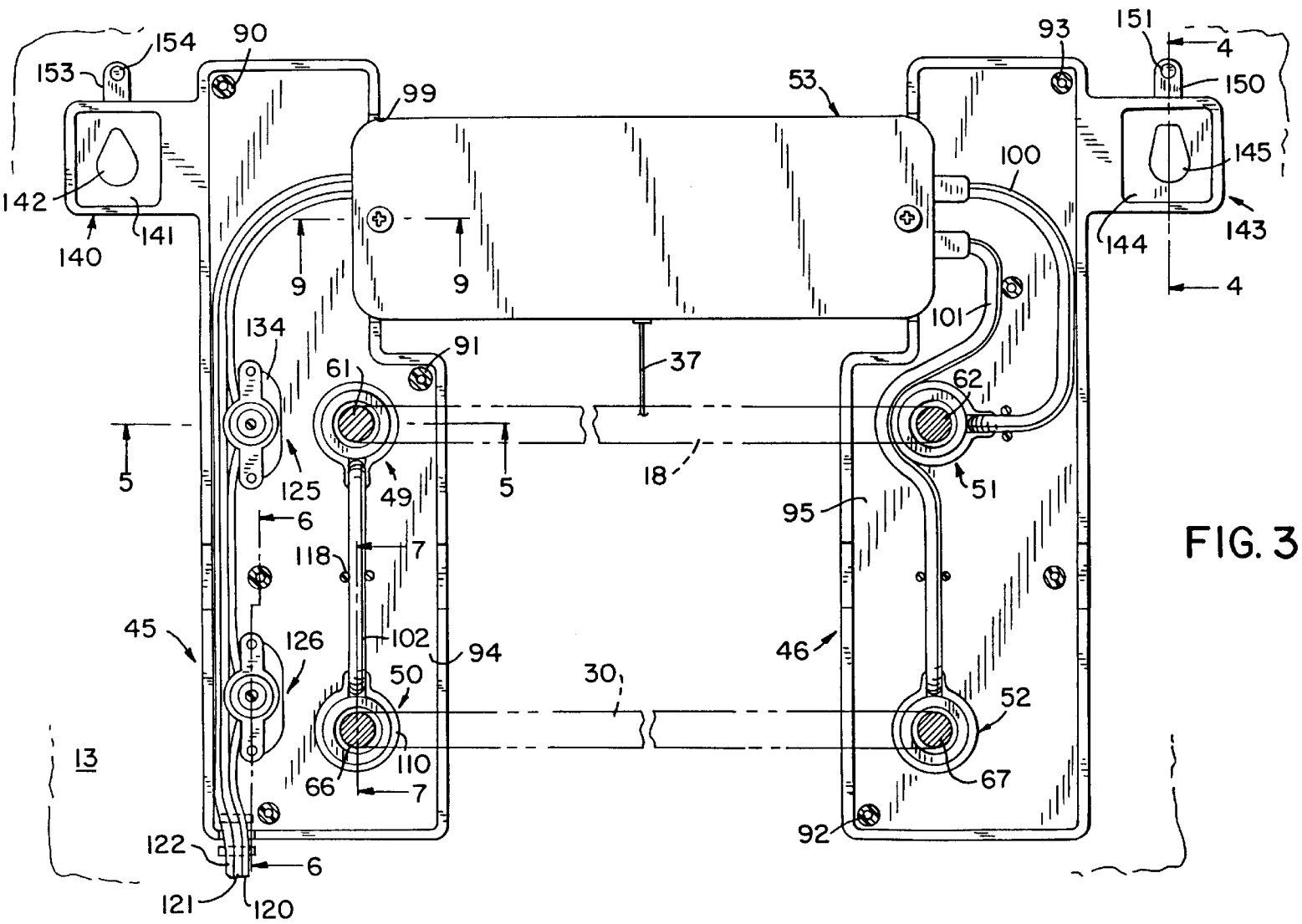
FIG. 3 is a frontal view of the left and right open faced electric circuitry chambers which along with a high voltage electronic power supply, are mounted to a generally planar base member and without either of the neon tubing carrying panels being superposed on the base member as yet for plugging the tube terminals into the electrical receptacles in the chambers.

Electrical features of the new sign will now be discussed primarily in reference to FIG. 3. The two separate molded chambers 45 and 46 were briefly alluded to in connection with discussing FIG. 1 earlier. In FIG. 3 it is evident that the fronts of chambers 45 and 46 are open but they are closed in fact since they are mounted to the backside of base member panel 13 as shown in FIG. 2. In FIG. 3, the generally planar base member 13 can be considered to be transparent so one can actually see into chambers 45 and 46 from the front of the sign.

For mounting the chambers 45 and 46 to base member 13 there are provided plastic bosses projecting from the backside of base member 13. There are four bosses for holding each chamber. Two typical bosses for holding chamber 45 are shown in section and are marked 90 and 91 and two of four typical bosses for holding chamber 46 are marked 92 and 93. Screws, not shown, pass with clearance through the bottoms 94 and 95 of chambers 45 and 46 and thread into the bosses. The screws may be the self tapping kind.

Figure 9:
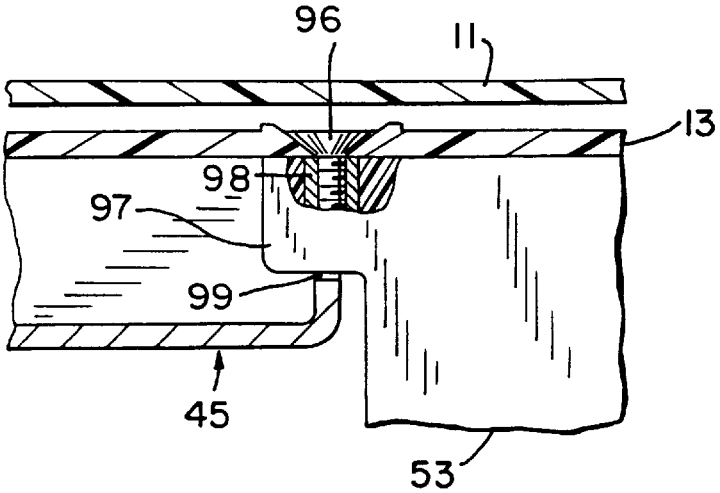
FIG. 9 is a fragmentary sectional view taken on a line corresponding to 9—9 in FIG. 3 to show how the power supply is fastened to the base member of the sign.

The power supply 53 was mentioned earlier in reference to FIG. 2 where a casing containing the electronic circuitry, not shown, for developing a high voltage and high frequency current to excite the series connected neon tubing configurations 18 and 30. As shown in more detail in FIG. 9, the power supply casing 53 is fastened to the backside of base member 13 by means of screws, one of which is marked 96 in FIG. 9. The power supply casing has a shoulder 97 which provides a threaded insert 98 for fastening the casing rearwardly of base member 13 with screw 96. Typical chamber 45 has a notch 99 into which shoulder 97 of the power supply casing extends.

The contents of the chambers 45 and 46 will now be discussed in greater detail in reference to FIG. 3. Two insulated lead wires 101 constitute the high voltage and high frequency output lines from power supply 53. Lead wire 100 connects to a spring contact, not visible in FIG. 3, in receptacle 51 and has end terminal 62, shown in section, of neon tubing 18 plugged into it. The structural details of receptacles 49, 51 and 50, 52 will be described in detail later. In FIG. 3, the current path from receptacle 51 is through neon tubing 18, symbolized by phantom lines marked 18, and then to receptacle 49. An insulated jumper wire 102 connects receptacle 49 to receptacle 50 in which an end terminal 66 of neon tubing 30 on front panel 12 is plugged in. The electric current path continues through symbolically represented neon tubing 30 on front panel 12 to receptacle 57 in chamber 46. The end terminal 67 of neon tubing configuration 30 is shown in section in FIG. 3 and is shown plugged into receptacle 52. The circuit then continues to an output of the power supply through a jumper or lead 101. Thus, it will be evident that neon tubing 18 on front panel 11 is connected in series with neon tubing 30 on front panel 12 and the series circuit is connected across the output terminals of power supply 53.

The details of a typical receptacle 50 are shown in section in FIG. 7. The receptacle comprises a tubular member 110 composed of insulating material such as a plastic. The tubular member is coaxial with a cylindrical element 111 formed on and extending from the backside of base member 13. The wall of element 111 has a keyway and a key 112 is formed on sleeve 110. Key 112 registers in the keyway to prevent tubular member 110 from rotating and withdrawing from chamber 45. Chamber 45 has a pocket 113 formed in it. The interior cavity of the pocket is marked 114. The lower end of tubular member 110 rests in the pocket. A conductive spring wire 115 resides in tubular member 110 and serves as a resilient contact for neon tubing terminal 66 to contact when the terminal is plugged into the receptacle as it is in FIG. 7. The wire end 116 of jumper 102 is soldered or welded to contact spring 115 at 117. Jumper 102 is held straight by being pressed between two pins 118.

At the lower left region of FIG. 3, one may see three electrical lines 120, 121 and 122. These three lines are the low voltage, usually 120 volt 60 Hz power infeed lines for the power supply 53. The lines would be connected to a 3-prong attachment plug, not shown. Lines 120 and 121 are each 120 volt, 60 Hz lines that connect to two of the prongs of the attachment plug and line 122 is a ground line. Infeed line 120 has series connected momentary switches in it. The switches are designated generally by the numerals 125 and 126. The switches are closed and conductive only if the front panels 11 and 12 are closely juxtaposed to the base member 13. The switches close when they are penetrated by small pins 127 and 128 which extend integrally and rearwardly of front panels 11 and 12, respectively. These pins are shown in FIG. 1 where the pin on front panel 11 is marked 127 and the pin on front panel is marked 128. It will be evident that one switch 125 could be installed in line 120 as shown and the other switch could be installed in line 121 in which case both switches would still be connected in series with the power supply infeed terminals. If the switches would be of the type that have outwardly extending operating pins, the pin 127 and 128 could be eliminated since simply pressing the front panels 11 and 12 against base member 13. In any case a switch will open immediately to deenergize the power supply if either of the front panels 11 or 12 is unlatched from base member 13.

Figure 5:
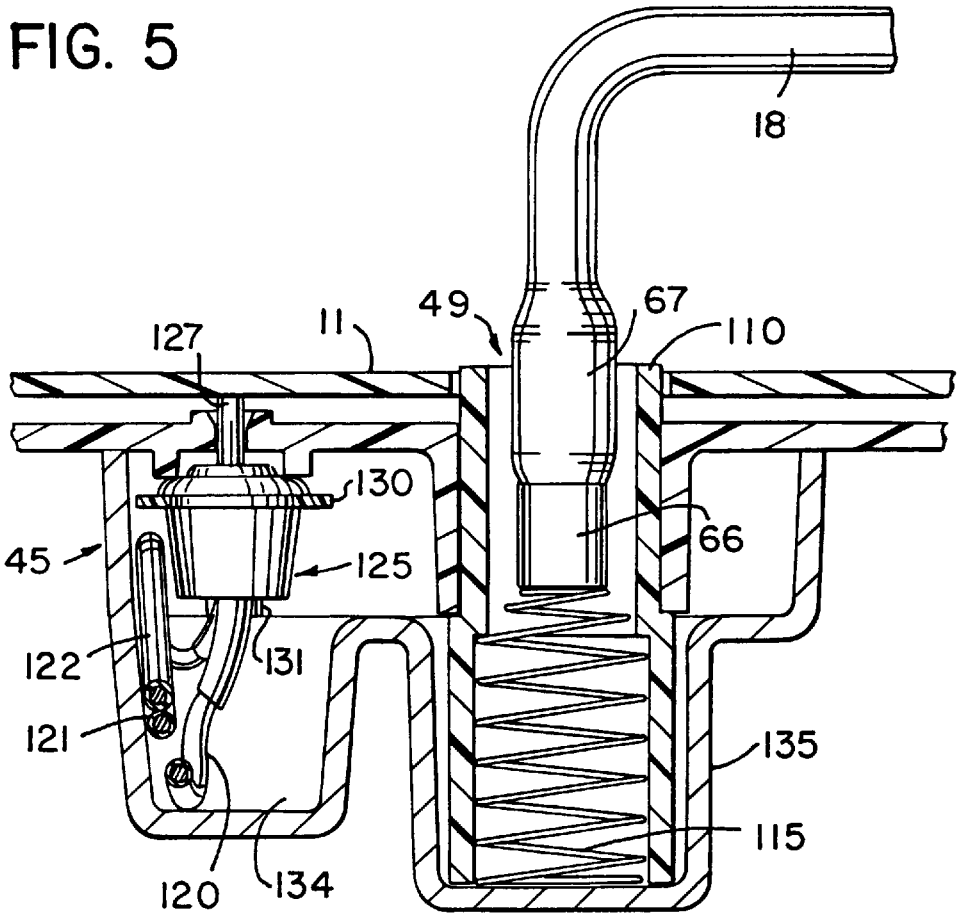
FIG. 5 is a fragmentary sectional view taken on a line corresponding to 5—5 in FIG. 3 and showing a self opening momentary switch and one of the springs occupying the electrical receptacles in a circuit chamber with an end terminal of a neon tube plugged into the receptacle.

Details of the commercially available momentary switches 125 and 126 are shown in FIGS. 5 and 6, respectfully. In FIG. 5, which corresponds to section 5—5 in FIG. 3, the switch 125 is supported on a perforated mounting plate 130. Pin 127 for actuating the switch extends from the back of front panel 11 and is plunged into switch 125 so the switch is closed or conductive. Plate 130 has cylindrical support legs extending downwardly from it. Only the lower end of one of the legs 131 is visible in FIG. 5 because of it being taken as a sectional view. FIG. 6, on the other hand, shows the other momentary switch mounted on a plate 132 which is the same as 130 where the two cylindrical legs are marked 132 and 133 are visible.

Focusing on FIG. 5, one may see that switch 125 resides in a pocket 134 formed in left chamber 45. Another pocket 135 contains the contact spring and cylindrical member 110 which are identical to those parts in FIG. 7 so discussing them again is unnecessary. FIG. 5 does not show the wire jumper 102 soldered to the contact spring but it should be understood that the jumper is soldered to the spring. The solder connection 117 in FIG. 7 is illustrative.

Refer now to FIG. 6 which is a section taken on the line 6—6 in FIG. 3. Here the other momentary switch 126 is shown. The legs 132 and 133 of the switch support which were briefly alluded to above are shown to have central bores to provide for mounting the switch support on two pins 134 and 135 which project integrally from the back of base member 13 and fit tightly in the cylinders 132 and 133, respectfully. When the front panel 12 interfaces with base member 13 or is juxtaposed to the base member, a pin 128 projects from the rear of front panel 12 and plunges into the switch to thereby close it. The location of pin 128 on panel 12 is revealed in FIG. 2. FIG. 6 also exhibits a typical screw 134 and a boss 136 combination for securing typical chamber 45 to the backside of base member 13. The boss 136 is molded integral with the base member 13.

Figure 4:
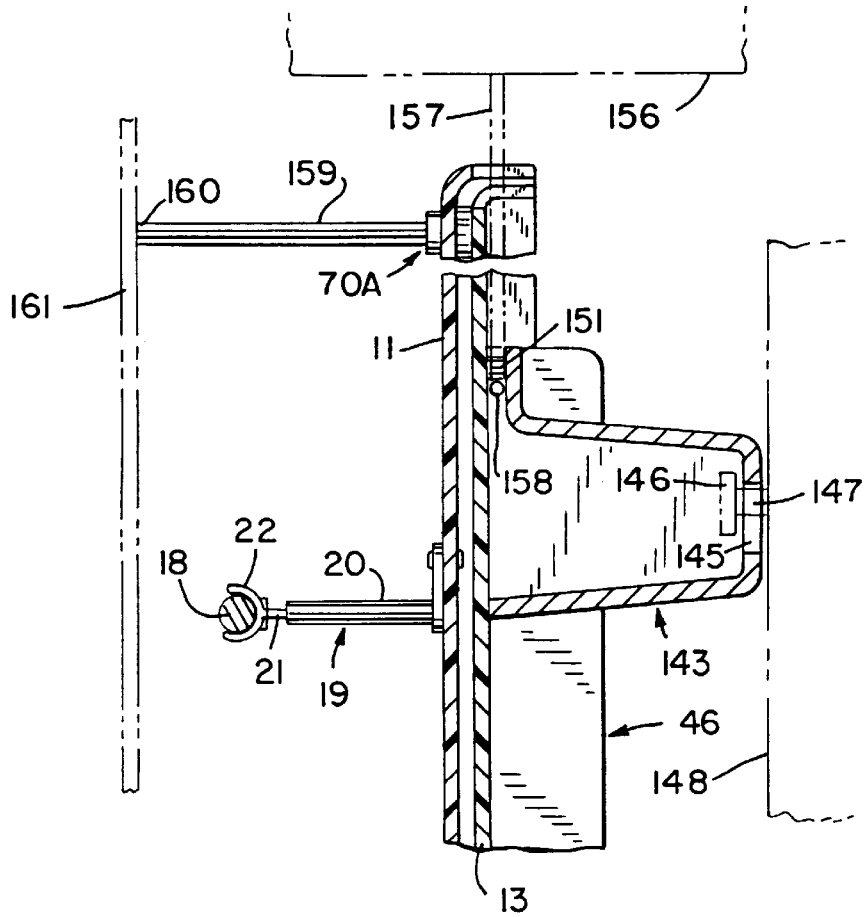
FIG. 4 is a fragmentary sectional view taken on a line corresponding to 4—4 in FIG. 3, showing a hanger element formed on the sign base member for wall mounting the sign and also showing one of the latchable standoff elements that are used to keep the neon tubing from impacting the glass when the sign is hung in a window.

FIGS. 3 and 4 show how the sign is adapted for being mounted on a wall, for example, or next to a window. FIG. 3 shows that the left electrical chamber 45 has a laterally and rearwardly extending hanger pocket 140. The rear wall 141 of the pocket 140 has a tear drop shaped hole 142. Right chamber 46 also has a laterally extending pocket marked 143. The back wall of pocket 143 is marked 144 and its hole is marked 145.

A section of right pocket 143 is shown in FIG. 4. Here one may see that a headed pin means 146, such as a nail, screw or bolt is set in a wall 148 shown in phantom lines. The head 146 is allowed to pass through the largest part of hole 145 (and hole 142) and the sign is allowed to descend by a small amount to rest on the shank 147 of the pin means. As should be evident, head 146 stops the sign from sliding off the pin.

Attention is invited to FIG. 3 again, particularly, to a tab 150 which extends from right pocket 143 and has an integrally molded pin 151. A similar tab 153 and a pin 154 are present on left pocket 130. Pins 154 lie on the same horizontal plane. When the chambers 45 and 46 are mounted to the backside of a planar area of base member 13, the ends of pins 151 and 154 interface with base member 13 so there is no gap between the pins and the base member.

FIG. 4 shows typical pin 151 in profile. In this case the sign is hung from a ceiling 156 shown in phantom lines. A flexible member 157 which can be a cord, wire or chain terminates in a hook 158 that loops around pin 151 to accept the comparatively low weight of the sign.

According to the invention, provision is made for protecting the neon tubing against impacting a window when the sign is suspended from overhead and the neon tubing is presented toward the window of a building. FIG. 4 illustrates how neon tubing 18 is protected by using latch keys that are formed with an integral standoff element 159. In FIG. 4, the latch key is indicated generally by the numeral 70A. It is structurally identical to latch key 70 which is shown in detail in FIG. 8. In FIG. 4, latch key 70A is one of several used for latching neon tube carrying front panels 11 and 12 to base member 13. The standoff element or rod 159 is an integral molded part of the modified latch key 70A. Its distal end 160 is bearing against a glass window represented by phantom lines marked 161. It should be evident that the standoff elements or rods assure that the neon tubing 18 will not collide with the window.

I claim:

1. An interchangeable neon sign comprising:

a base member having a front and a rear and a pair of apertures;

at least a first set of two laterally spaced apart electrical receptacles mounted to the rear of said base member in alignment with said apertures, a neon tubing power supply supported by said base member, said power supply having output terminals connected, respectively, to said first set of two electrical receptacles, a first front panel having front and rear surfaces and a neon tubing configuration mounted to said front surface to face away from said base member, the tubing configuration having opposite end terminals projecting rearwardly of said rear surface and spaced apart by a same distance as are the first set of two electrical receptacles to provide for said end terminals to plug, respectively, into said first set of two electrical receptacles when said first front panel is juxtaposed to said base member for said tubing configuration to form a closed circuit connecting said opposite end terminals of the neon tubing configuration to said output terminals of said power supply, and, means for latching said first front panel to said base member which comprises:

a plurality of latch keys each including an axially extending shank having a head and two prongs extending radially from said shank with a fixed angle between the prongs, said prongs having radial lengths and having narrow widths providing for the prongs to pass through an elongated keyhole in said first front panel and an elongated keyhole in said base member with clearance concurrently, said keyholes having widths slightly greater than the widths of the prongs, rotation of said shank after said prongs have passed through the keyhole in the base member causing said prongs to extend crosswise of the width of said keyhole in the base member and said head to abut said first front panel to prevent said first front panel from separating from the base member.

2. The interchangeable neon sign according to claim 1 including:

a second set of two laterally spaced apart electrical receptacles mounted to said base member and nominally vertically spaced from said first set of two electrical receptacles;

a second front panel arranged adjacent said first front panel, said second front panel having front and rear surfaces and a second neon tubing configuration being mounted to said front surface of said second front panel to face away from said base member, the second tubing configuration having opposite end terminals projecting rearwardly of said rear surface of said second front panel and spaced apart by a same distance as are said second set of two laterally spaced apart electrical receptacles to provide for said end terminals of said second neon tubing configuration to plug, respectively, into said second set of two electrical receptacles when said second front panel is juxtaposed to said base member, the end terminals of each of said neon tubing configurations being plugged into cooperating receptacles thereby connecting said neon tubing configurations in series with each other.

3. The interchangeable neon sign according to claim 2 including:

switch means mounted to said base member in a circuit for connecting said power supply to an electric power source, interlock means operative in response to both of said first and second front panels having been installed on said base member to actuate said switch means to a conductive state for energizing said power supply.

4. The interchangeable neon sign according to claim 1 including:

power input lines for connecting said power supply to an electric power source, a switch supported from said base member and connected in one of said power input lines, an element projecting rearwardly of said rear surface of said first front panel for engaging said switch when said front first panel is juxtaposed to said base member and thereby operating said switch to a closed circuit condition to energize said power supply.

5. The interchangeable neon sign according to claim 2 including:

power input lines for connecting said power supply to an electric power source, first and second switches supported from said base member in spaced apart relationships said switches connected such that both must be operated to a closed circuit connection before current can flow by way of said power input lines to said power supply, an element projecting rearwardly from each of said rear surfaces of said first and second front panels and arranged such as to engage and operate said switches, respectively, to a closed condition when both of said first and second front panels are juxtaposed to said base member so that said power supply can not be energized unless both front panels are in juxtaposition to said base member.

6. An interchangeable neon sign comprising:

a base member composed of electrically nonconductive material and having front and back surfaces, a power supply for neon tubing mounted to the back surface of the base member and having a plurality of output terminals, left and right chambers of nonconductive material, each chamber having a rear wall, side walls and an open front face opposite of its rear wall, said chambers are mounted laterally spaced apart to said back surface of said base member in a manner for the open front face of both of the chambers to interface with and be covered by said back surface of the base member, said base member having a first pair of laterally spaced apart apertures with a first aperture of the first pair of apertures superposed over said front face of said left chamber and a second aperture of the first pair of apertures superposed over the front face of said right chamber, said base member having a second pair of laterally spaced apart apertures spaced nominally vertically from the first pair of apertures with a first aperture of the second pair of apertures superposed over the front face of said left chamber and a second aperture of the second pair of apertures superposed over the right chamber, electrical receptacles arranged in said chambers in alignment with the apertures, each receptacle containing an electric contact element, a first front panel having a pair of laterally spaced apart holes arranged for alignment with said apertures, respectively, in said first pair of apertures when said first front panel is juxtaposed to said base member, a second front panel having a pair of laterally spaced apart holes arranged for alignment with said apertures, respectively, in said second pair of apertures when said second front panel is juxtaposed to said base member, neon tubing configuration mounted, respectively, to the first and second front panels, the neon tubing configurations on the first and second front panels having electrical end terminals coinciding, respectively, with said holes in the first front panel and second front panel, respectively, so the end terminals of the tubing configuration on the first front panel plug into said receptacles aligned with said first pair of apertures, and the end terminals of the tubing configuration on the second front panel to plug into said receptacles aligned with said second pair of apertures when said front panels are juxtaposed to said base member, and means for releasably latching said front panels to said base member.

7. The interchangeable neon sign according to claim 6 wherein:

an output terminal of said power supply is connected to one of said electrical receptacles in one of said chambers into which one of the end terminals of the neon tubing configuration on the first front panel plugs and another terminal connects to an electrical receptacle in said one of said chambers into which a corresponding one of the end terminals of the neon tubing configuration on the second front panel plugs, means for interconnecting the electrical receptacles in other than said one of said chambers into which receptacles the end terminals of the neon tubing configurations on the first and second front panels, respectively, plug so that said neon tubing configurations are connected in a series circuit between the terminals of the power supply.

8. The interchangeable neon sign according to claim 6 including circuitry for connecting said power supply to an electric power source, including:

a pair of normally open switches mounted in one of the chambers and connected in a series circuit including input terminals of said power supply so that both switches must be closed before said power supply can be energized from said power source, placement of said first front panel in juxtaposition to said base member causing a first one of said switches to close and placement of the second front panel in juxtaposition to said base member causing a second one of said switches to close.

9. The interchangeable neon sign according to any one of claims 7 or 8 including an electric contact spring in each receptacle for being contacted by a plugged in end terminal of said neon tubing configurations.

10. The interchangeable neon sign according to claim 6 wherein said means for latching said front panels to said base member comprises:

a plurality of latch keys each including an axially extending shank having a head and two prongs extending radially from said shank with a fixed angle between the prongs, said prongs having radial lengths and having narrow widths providing for the prongs to pass through an elongated keyhole in one of said front panels and an elongated keyhole in said base member with clearance concurrently, said keyholes having widths slightly greater than the widths of the prongs, rotation of said shank after said prongs have passed through the keyhole in the base member causing said prongs to extend crosswise of the width of said keyhole in the base member and said head to abut said one of said front panels to prevent the front panel from separating from the base member.

11. The interchangeable neon sign according to claim 10 wherein:

a rod projecting from the head of each latch key in a direction opposite from said shank is provided for keeping said neon tubing configurations spaced from a window when the sign is hung facing the window.

12. The interchangeable neon sign according to claim 6 including:

a pocket member projecting unitarily in one direction from said left chamber and a pocket member projecting unitarily in a direction opposite of said one direction from said right chamber, the pocket members having open front faces coplanar with the open front faces of the chambers for interfacing with and being closed by said base member, said pocket members each having a hanger hole to provide for hanging the sign for the neon tubing configuration on said front panels to be viewed.

13. The interchangeable neon sign according to any one of claims 1 or 6 wherein said first front panel and said base member are composed of a clear plastic material.

14. The interchangeable neon sign according to claim 13 wherein said plastic material is polycarbonate resin.

* * * * *